US009783907B2

(12) United States Patent
Cai et al.

(10) Patent No.: US 9,783,907 B2
(45) Date of Patent: Oct. 10, 2017

(54) TUNING NANO-SCALE GRAIN SIZE DISTRIBUTION IN MULTILAYERED ALLOYS ELECTRODEPOSITED USING IONIC SOLUTIONS, INCLUDING AL—MN AND SIMILAR ALLOYS

(75) Inventors: Wenjun Cai, Cambridge, MA (US); Christopher A. Schuh, Ashland, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 292 days.

(21) Appl. No.: 14/235,834

(22) PCT Filed: Aug. 2, 2012

(86) PCT No.: PCT/US2012/049371

§ 371 (c)(1),
(2), (4) Date: Sep. 8, 2014

(87) PCT Pub. No.: WO2013/066454

PCT Pub. Date: May 10, 2013

(65) Prior Publication Data

US 2014/0374263 A1 Dec. 25, 2014

Related U.S. Application Data

(60) Provisional application No. 61/514,374, filed on Aug. 2, 2011.

(51) Int. Cl.
*C25D 21/12* (2006.01)
*C25D 3/66* (2006.01)
(Continued)

(52) U.S. Cl.
CPC ..... *C25D 21/12* (2013.01); *C25D 3/56* (2013.01); *C25D 3/66* (2013.01); *C25D 3/665* (2013.01);
(Continued)

(58) Field of Classification Search
CPC ..... C25D 3/665; C25D 5/16; C25D 5/18
See application file for complete search history.

(56) References Cited

U.S. PATENT DOCUMENTS 6,217,737 B1 4/2001 Baumann
6,966,800 B2 11/2005 Mott
(Continued)

FOREIGN PATENT DOCUMENTS

CN 101238243 A 8/2008
JP 1994-196324 7/1994
(Continued)

OTHER PUBLICATIONS

Second Office Action and Search Report from the State Intellectual Property Office of People's Republic of China dated Aug. 9, 2016, for Chinese Application 201280048552, which is the Chinese National Phase of PCT/US12/49371, of which the present application is the U.S. National Phase.
(Continued)

*Primary Examiner* — Brian W Cohen
(74) *Attorney, Agent, or Firm* — Steven J. Weissburg

(57) ABSTRACT

Al—Mnx/Al—Mny multilayers with a wide range of structures ranging from microcrystalline to nanocrystalline and amorphous were electrodeposited using a single bath method under galvanostatic control from room temperature ionic liquid. By varying the Mn composition by ~1-3 at. % between layers, the grain sizes in one material can be systematically modulated between two values. For example, one specimen alternates between grain sizes of about 21 and 52 nm, in an alloy of average composition of 10.3 at. % Mn. Nanoindentation testing revealed multilayers with finer grains and higher Mn content exhibited better resistance to plastic deformation. Other alloy systems also are expected to be electrodeposited under similar circumstances.

25 Claims, 3 Drawing Sheets

(51) Int. Cl.

| | |
|---|---|
| ***C25D 5/10*** | (2006.01) |
| ***C25D 5/18*** | (2006.01) |
| ***C25D 3/56*** | (2006.01) |
| *C25D 17/10* | (2006.01) |

(52) U.S. Cl.
CPC ..... *C25D 5/10* (2013.01); *C25D 5/18* (2013.01); *C25D 17/10* (2013.01)

(56) References Cited

U.S. PATENT DOCUMENTS

| | | | | |
|---|---|---|---|---|
| 2005/0227484 | A1* | 10/2005 | Gu | C25D 5/02 438/667 |
| 2006/0272949 | A1* | 12/2006 | Detor | C25D 3/56 205/238 |
| 2008/0041727 | A1 | 2/2008 | Kim et al. | |
| 2009/0159451 | A1 | 6/2009 | Tomantschger | |
| 2009/0217812 | A1 | 9/2009 | Whitaker et al. | |
| 2010/0108524 | A1* | 5/2010 | van Mol | C25D 5/10 205/50 |
| 2010/0200050 | A1 | 8/2010 | Aksu et al. | |
| 2011/0083967 | A1* | 4/2011 | Ruan | C25D 3/665 205/238 |
| 2012/0031766 | A1* | 2/2012 | Inoue | C25D 3/44 205/102 |
| 2012/0118745 | A1* | 5/2012 | Bao | C25D 5/10 205/50 |

FOREIGN PATENT DOCUMENTS

| | | | | |
|---|---|---|---|---|
| JP | 2008-166645 | | 7/2008 | |
| WO | 0123645 | | 4/2001 | |
| WO | WO 2010005983 | A2 * | 1/2010 | C25D 5/10 |
| WO | WO 2010005993 | A2 * | 1/2010 | C25D 5/10 |
| WO | WO 2010144509 | A2 * | 12/2010 | C25D 5/10 |
| WO | 2010144509 | | 12/2016 | |

OTHER PUBLICATIONS

Office Action from the Japanese Patent Office dated Jun. 29, 2016 for Japanese Application 2014-524084, which is the Japanese National Phase of PCT/US12/49371, of which the present application is the U.S. National Phase.

Office Action from the Japanese Patent Office dated Dec. 31, 2016, for Japanese Application 2014-524084, which is the Japanese National Phase of PCT/US12/49371, of which the present application is the U.S National Phase.

Shiyun Ruan, Christopher A. Schuh—Electrodeposited A1-Mn Alloys With Microcrystalline, Nanocrystalline, Amorphous and Nano-Quasicrystalline Structures, SienceDirect (Received Mar. 10, 2009; Accepted Apr. 19, 2009).

First Office Action and Search Report from the State Intellectual Property Office of People's Republic of China dated Oct. 30, 2015 for Chinese Application 201280048552 which is the Chinese National Phase of PCT/US12/49371 of which the present application is the National Phase.

Communication and Supplementary Search Report from the European Patent Office dated on Jul. 5, 2015 for European Application No. 12846136.5 which is the European Regional Phase of PCT/US12/49371 of which the present application is the national phase.

PCT International Search Report and the Written Opinion of the International Searching Authority, or the Declaration dated Apr. 15, 2013 for PCT/US12/49371 of which the present application is the national phase.

PCT International Preliminary Report on Patentability mailed on Feb. 13, 2014 for PCT/US12/49371 of which the present application is the national phase.

* cited by examiner

TUNING NANO-SCALE GRAIN SIZE DISTRIBUTION IN MULTILAYERED ALLOYS ELECTRODEPOSITED USING IONIC SOLUTIONS, INCLUDING AL—MN AND SIMILAR ALLOYS

RELATED DOCUMENTS

This is the 35 U.S.C. §371 U.S. National Phase of Patent Cooperation Treaty application No. PCT/US2012/049371, entitled, TUNING NANO-SCALE GRAIN SIZE DISTRIBUTION IN MULTILAYERED ALLOYS ELECTRODEPOSITED USING IONIC SOLUTIONS, INCLUDING Al—Mn AND SIMILAR ALLOYS, International filing date of Aug. 2, 2012, to which the benefit of priority is hereby claimed. The PCT application claims the benefit of U.S. Provisional application No. 61/514,374, filed on Aug. 2, 2011, entitled TUNING NANO-SCALE GRAIN SIZE DISTRIBUTION IN MULTILAYERED ALLOYS, INCLUDING Al—Mn AND SIMILAR ALLOYS. The priority benefit of the provisional application is hereby claimed and the entire disclosure of each application mentioned above is hereby incorporated fully herein, by reference.

GOVERNMENT RIGHTS

This invention was made with Government support under Contract No. W911NF-07-D-0004 awarded by the Army Research Office. The United States Government has certain rights in the invention.

INTRODUCTION

Nanostructured materials have been shown to exhibit high strength, strong strain rate sensitivity, and in some cases work-hardening ability, ductility and damage tolerance. These properties, if they could be delivered together, constitute an ideal target for structural and engineering applications. Unfortunately, there is not generally a single grain size that simultaneously optimizes all of these properties. For example, nanostructured face centered cubic materials with a uniform grain size of about 10 nm are known to optimize strength and rate sensitivity, but do not necessarily optimize strain hardening capacity or toughness. Similarly, nanocrystalline grains are beneficial for slowing fatigue crack initiation under cyclic loading, but detrimental in terms of fatigue crack propagation. In order to take full advantage of the tremendous potential of nanostructured materials, a higher order of microstructure design, combining the various optimum grain sizes for each property, may be needed. Examples of prior work using this strategy include bimodal grain size nanocrystalline materials, nanotwinned structures that have a characteristic twin spacing considerably different than the grain size, functionally graded nanocrystalline materials, and recently, modulated or multilayer nanocrystalline materials.

It is desired to be able to produce articles having a hierarchy of structures and structural length scales, grain sizes and compositions, and in a geometry that is conducive to the deposition technologies that are most pertinent to commercialization of nanocrystalline materials. It is also desired to explore the possibility of achieving new material properties. It is also desirable to be able to provide materials that cannot be obtained using aqueous deposition techniques.

These and other objects and aspects of inventions disclosed herein will be better understood with reference to the Figures of the Drawing, of which:

BRIEF DESCRIPTION OF THE FIGURES OF THE DRAWING

FIG. 1 (in six parts, 1*a*, 1*b*, 1*c*, 1*d*, 1*e* and 1*f*) shows scanning electron microscopy (SEM) digital images of the surface and cross-sections of three multilayered Al—Mn samples 1, 2 and 3, in which cross-section samples were prepared by ion milling a trench from sample surface using focused ion beam (FIB), with.

FIG. 2 (in six parts, 2*a*, 2*b*, 2*c*, 2*d*, 2*e* and 2*f*) shows Cross-section TEM digital images and selected area diffraction (SAD) patterns of samples 1, 2 and 3, respectively, with.

BRIEF SUMMARY

Figure 1A:
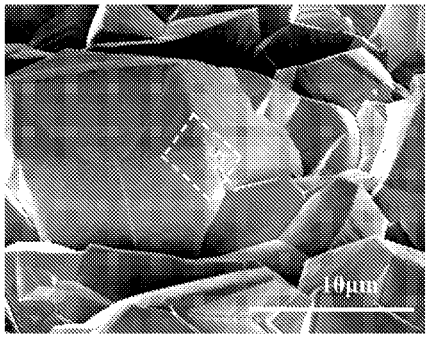
FIG. 1*a* showing the surface of sample 1.
Figure 1B:
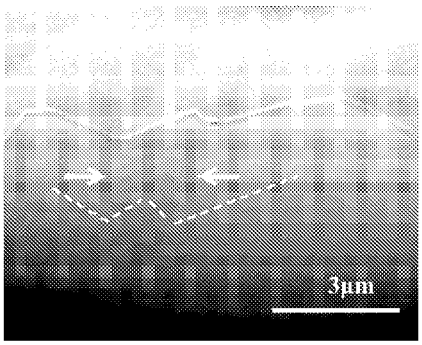
FIG. 1*b* showing a cross-section of sample 1.
Figure 1C:
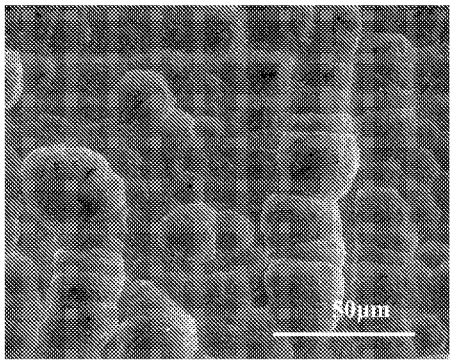
FIG. 1*c* showing the surface of sample 2.
Figure 1D:
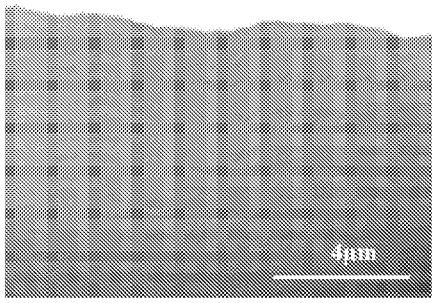
FIG. 1*d* showing a cross-section of sample 2.
Figure 1E:
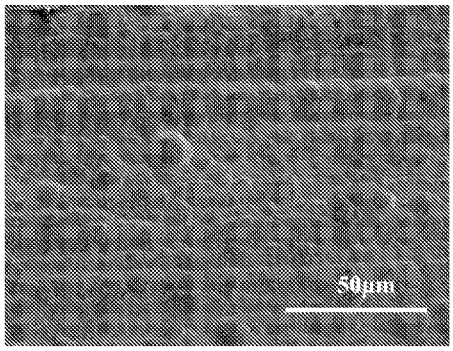
FIG. 1*e* showing the surface of sample 3.
Figure 1F:
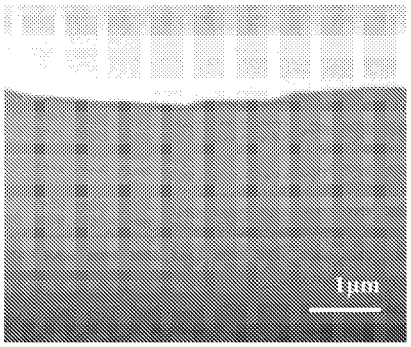
FIG. 1*f* showing a cross-section of sample 3.

A single-bath electrodeposition process is disclosed herein, which is a versatile, economical, and scalable route to produce complex shapes. During electrodeposition in a properly designed system, deposition is made in layers. Composition modulation from one layer to the next is obtained using galvanostatic or potentiostatic control. The layer thickness is controlled by monitoring the transferred charge. Thus, it is possible using methods disclosed herein to achieve layered structures, having layers of different thicknesses and composition, at controlled, specified, different locations throughout the thickness of the formed article. Further, the grain size and grain structure is also controlled, and different, at specified locations throughout the thickness of the article. Additionally, new material properties arise from the presence of an additional length-scale (layer thickness), the interactions of the constituent materials, as well as the interface properties between nanocrystalline layers. For a deposit where all of the layers have the same thickness, this additional length scale can be thought of as simply layer thickness. However, in many useful applications, adjacent layers are not the same thickness. In such a case, however, it is common for a pattern of layer thicknesses to repeat periodically in sets of consecutive layers. For instance, layers of two thicknesses A and B, may repeat in the pattern AB AB AB . . . to form sets of two layer thicknesses. Thus, the pair of layers AB repeat, and their combined thickness repeats. In such a case, rather than layer thickness, it is convenient to think of a wave-length of layer pattern repeat as the additional length scale. Layer wavelength is the thickness of the repeating units of layers, for instance AB above. The concept of layer wavelength can be extended to sets of three and more different layer thicknesses, for instance, appearing in the pattern ABC, ABC, ABC . . . to form sets of three layer thicknesses.

DETAILED DESCRIPTION

Inventions disclosed herein relate generally, but not always to a single-bath electrodeposition process, which is a versatile, economical, and scalable route to produce complex shapes. During electrodeposition in a properly designed system, composition modulation can be obtained using galvanostatic or potentiostatic control, and the layer thickness can be controlled by monitoring the transferred charge. Both galvanostatic (current) and potentiostatic (voltage) control may be used.

A unifying concept with both of these types of control is that the composition of the deposit is based on varying the electrical power level that is delivered to the electrodes, either by way of varying the current density, or the voltage. Thus, as used herein, electrical power control will be used to mean either galvanostatic control or potentiostatic control, or both. In the following discussion, examples are discussed most often using galvanostatic control. However, it will be understood that galvanostatic control is a specific type of electrical power control, and that analogous situations may exist using potentiostatic control. Our use of electrical power control is also intended to apply to pulse-plating scenarios, where the applied current density or applied voltage are not limited to constant (e.g., direct current or DC) conditions, but which contain programmed pulses. Such pulses may be of the same polarity or opposite polarity (e.g., reverse pulse plating), and may include periods of "off time". In such cases involving pulses, one "electrical power level" would correspond to a single defined pulsing scheme with definable features, such as duty cycle, amplitude, forward-, off- and reverse-time durations, etc., as is well known to those practiced in the art.

With room temperature ionic (also referred to herein at times as non-aqueous) liquids, it is possible to produce high quality dense films from a wide array of materials (such as Al, Ti, Mg and their alloys), which cannot be electrodeposited from aqueous solutions. These dense films can have tunable nanostructures. In the Al—Mn system in particular, recent work of a present inventor has shown that alloys with structures ranging from microcrystalline, to nanocrystalline (grain sizes from 100 to as fine as ~5 nm), to x-ray amorphous, can all be formed through electrodeposition. In the present disclosure, the tunability of this system is enhanced by using galvanostatic control to create multilayered nanostructured alloys with individual layers of each of these unique structures.

In general, the inventions described herein relate to materials that can be deposited using an ionic bath, but not an aqueous bath. The bath should be composed of at least two metal constituents, which deposit in different proportions from each other at different electrical power levels, such as at different current densities (or at different voltages). Typically, one of the metals (the one that deposits at the higher proportion) is considered to be a base material for the deposited alloy. It can be a light weight metal, including but not limited to Al, Ti and Mg. Or, it can be a heavier metal including but not limited to Cu, Ni, Ag, etc. The second element can be any possible alloying element relative to the first. Some possibilities for the metals mentioned above include but are not limited to: Mn, La, Pt, Zr, Co, Ni, Fe, Cu, Mg, Mo, Ti, W and Li. Extensive work has been conducted with Al—Mn systems, as discussed in more detail below. These elements are used here for illustration purposes only, and their explicit mention should not be taken to limit the generality of inventions discussed herein.

A room temperature ionic liquid electrolyte solution, which contains 1-ethyl-3-methylimidazolium chloride (EMIC) and anhydrous $AlCl_3$ in a molar ratio of 2:1, was prepared as reported in S. Y. Ruan and C. A. Schuh, *Acta Mater* 57 (13), 3810 (2009). Anhydrous $MnCl_2$, incorporated at 0.06, 0.09 and 0.12 mol/L was then added to the electrolyte to prepare three different baths, used to synthesize three different samples. Pure polycrystalline Cu and Al sheets were used as the cathode and anode, respectively, at a separation distance of 2 cm. All experiments were performed in a nitrogen-filled glove box with $O_2$ and $H_2O$ concentrations below 1 ppm. We electrodeposit multilayered Al—$Mn_x$/Al—$Mn_y$ (hereafter referred as Al—Mn for simplicity) by alternating the deposition between two levels of direct current, 4 and 10 mA/cm2, for durations of 144 and 60 sec respectively, accumulating to a total deposition time of 4 hours.

Material characterizations were performed using scanning electron microscopy (SEM), Energy-dispersive X-ray spectroscopy (EDS), transmission electron microscopy (TEM), selected area diffraction (SAD), and high angle angular dark-field (HAADF) imaging. Cross-sections for SEM observation were prepared by cutting a trench from sample surface using focused ion beam (FIB). Cross-section TEM samples were prepared by either standard lift-out technique in FIB or conventional mechanical grinding followed by ion milling. XRD of free standing Al—Mn multilayers were carried out using Cu Kα radiation source at 45 KV and 40 mA. Nanoindentation tests were performed on polished cross-section samples using Berkovich tip at 10 mN maximum load, 1 mN/s loading rate.

FIGS. 1*a*-1*f* show scanning electron microscopy (SEM) images of the surface and cross-sections of the three multilayered Al—Mn samples. All cross-section samples are coated with a protective Pt layer during sample preparation by FIB. Sample 1 (prepared at ($MnCl_2$)=0.06 mol/L) exhibits angular surface structures on the micrometer scale, characteristic of electrodeposited coarse grained films, where typically each angular surface feature corresponds to an individual grain. However, unlike conventional coarse-grained electrodeposits, periodic stripes on the order of hundreds of nanometers wide are observed on the exposed surfaces of the grains in this sample. These layers are produced by the current modulation, and in the present sample the structural layers can be inferred to form in an epitaxial fashion through the large grains. Even around an angular junction of several facets (see dashed lines in FIG. 1*a*) continuity of the layered structure can be observed. Dashed lines in FIG. 1*a* and FIG. 1*b* outline the nanometer scale layers formed in microcrystalline grains. Arrows in FIG. 1*b* indicate two grain boundary planes.

Samples 2 and 3 (prepared at ($MnCl_2$)=0.09 and 0.12 mol/L respectively) exhibit very different surface morphologies, comprising rounded nodular colonies with average characteristic sizes of 17 and 5 μm, respectively. These features are typical for electrodeposited materials with nanocrystalline structures; their presence is in fact a signature that a much finer nanostructure is likely present. SEM images of cross-sections (FIGS. 1*b*, 1*d* and 1*f*) clearly indicate the presence of composition modulations in the three samples, where the dark and light contrast correspond respectively to Mn-lean and -rich layers (noted as layers A and B hereafter) grown using 4 and 10 mA/$cm^2$ current density respectively. During alloy electrodeposition under galvanostatic control, an increase of current density favors the deposition of the less noble Mn. For all three samples, typical composition variations between layers A and B is ~1-3 at. % Mn (Table 1).

Figure 2A:
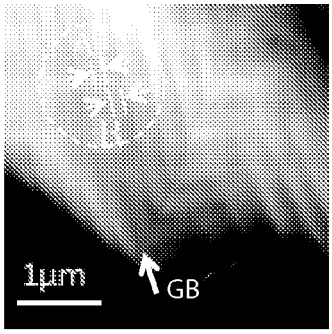
FIG. 2*a* showing the cross-section TEM of sample 1.
Figure 2B:
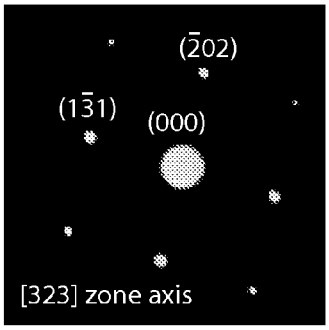
FIG. 2*b* showing a SAD patterns of sample 1.
Figure 2C:
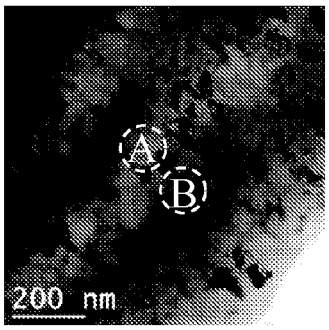
FIG. 2*c* showing the cross-section TEM of sample 2.
Figure 2D:
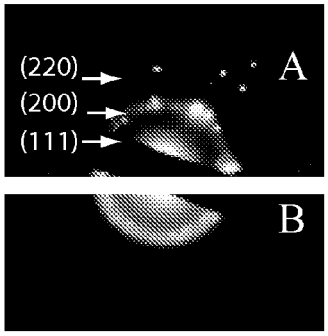
FIG. 2*d* showing a SAD patterns of sample 2.
Figure 2E:
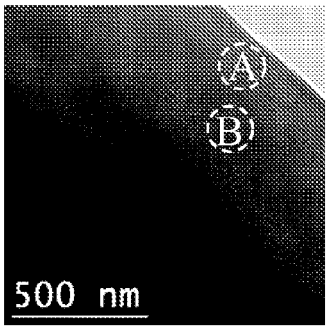
FIG. 2*e* showing the cross-section TEM of sample 3.
Figure 2F:
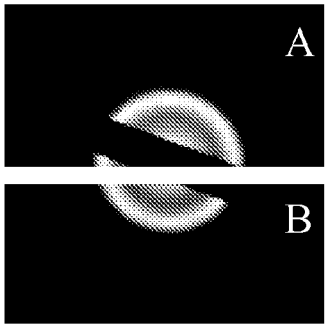
FIG. 2*f* showing a SAD patterns of sample 3.

The microstructures of the multilayers are further characterized using advanced transmission electron microscopy (TEM) techniques and X-ray diffraction (XRD). Cross-section TEM images and the corresponding selected area diffraction (SAD) patterns of the three samples are shown in FIGS. 2*a*-2*f*. FIG. 2*a* was taken under high angle angular dark-field (HAADF) imaging mode while FIG. 2*c* and FIG. 2*e* were taken under conventional bright field mode, with the SADs being taken from circled areas in corresponding TEM images, and the arrow in FIG. 2*a* indicating the presence of a grain boundary. In sample 1, each grain comprises sets of multiple consecutive layers of A and B with the same crystallographic orientation. XRD analysis of sample 1 confirms the formation of a single face-centered cubic (fcc) phase, indicating the formation of a solid solution of manganese in aluminum far beyond the equilibrium solubility. In sample 2, layer A contains fcc nanocrystalline grains of 52 nm while layer B comprises a duplex of fcc (with grain size of 21 nm) and amorphous phase. In sample 3, fcc nanocrystalline grains of 5.2 nm coexist with the amorphous phase in layer A, while layer B is almost completely amorphous with very few fcc grains of 3.2 nm. XRD analysis indicates average fcc phase of 47% and 17% are present in samples 2 and 3 respectively. High-resolution TEM (HRTEM) study of sample 3 also shows the occasional formation of icosahedral $Al_6Mn$ in the amorphous region, similar to those observed in monolithic Al—Mn with composition close to 14 at. % Mn.

It has been noted that in the Al—Mn system, the introduction of the secondary alloying element promotes finer structure, likely through a combination of effects. In the present work, by increasing local Mn concentration up to 15.9 at. %, grain sizes are tunable over orders of magnitude. When the additional length scale of layer thickness is introduced extrinsically through the processing conditions, a noteworthy array of new structures can be produced.

Figure 3:
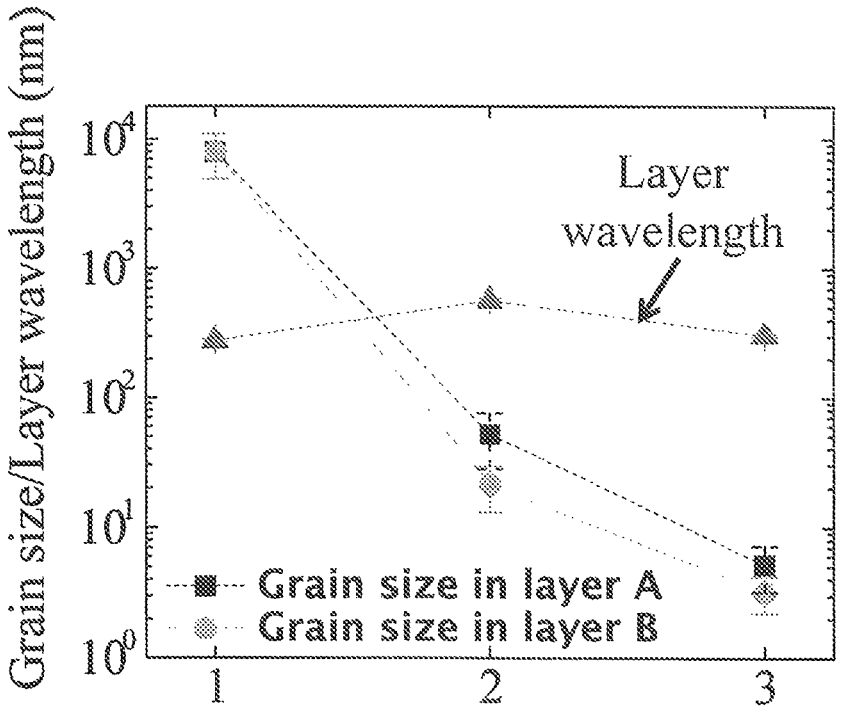
FIG. 3, which summarizes, graphically, the breadth of the materials produced by methods disclosed herein, focusing on the interplay of two length scales—grain size and layer wavelength, showing grain sizes and layer wavelengths of electrodeposited multilayered Al—Mn samples 1, 2 and 3.

FIG. 3 summarizes the breadth of the materials produced in this work, focusing on the interplay of the two length scales—grain size and layer wavelength. As mentioned above, in many useful applications, adjacent layers are not the same thickness. In such a case, however, it is common for a pattern of layer thicknesses to repeat periodically in sets of consecutive layers. For instance, layers of two thicknesses A and B, may repeat in the pattern AB AB AB . . . to form sets of two layer thicknesses. Thus, the pair of layers AB repeat, and their combined thickness repeats. In such a case, rather than layer thickness, it is convenient to think of a wave-length of layer pattern repeat as the additional length scale, layer wavelength is the thickness of the repeating units of layers, for instance AB above. The concept of layer wavelength can be extended to sets of three and more different layer thicknesses, for instance, appearing in the pattern ABC, ABC, ABC . . . to form sets of three layer thicknesses.

It has been possible to produce materials in which either of these two scales is larger than the other. The intersection of the two curves in FIG. 3 marks the transition between two types of microstructures.

For the first type, when the grain size is larger than the layer wavelength, composition modulations occur within individual crystals, leading to a conventional multilayer structure, with an epitaxial relationship (no grain boundaries) between the layers. In the present case these multilayers are polycrystalline, with the layer structure appearing in each individual grain, such as in sample 1. In making these comparisons between wavelength and grain size, by grain size of the deposit, it is useful to use the average grain size of the different layers that make up one wavelength unit.

For the second type, when the grain sizes are smaller than the layer wavelength, composition modulations lead to nanostructure modulation, which are directly controlled by the applied current waveform in the present work, such as samples 2 and 3. Whereas multilayers with two alternating grain sizes are one class of materials produced here it is also possible to prepare multilayers combining amorphous and nanocrystalline layers.

It will be understood that some structures will include amorphous structures, which have no recognizable grains, and thus, no identifiable grain size. In the context of these structures, rather than comparing wavelength to an average grain size, it is also useful to consider the size of the layer wavelength relative to only the grain size of any crystalline layers in the deposit. Further, even with classes of materials that have layers of only crystalline materials, it is also useful to consider the relative size of the layer wavelength to the largest grain size within the set of layers, or to the smallest grain size within the set of layers. Transitions in these comparisons may also be of value to the designer. As such, there can be even more than two types of materials, because the wavelength can be larger than the largest grain size, smaller than the smallest, and also in-between the two. Other types may also be envisioned, considering averaging grain size as mentioned, in different weighted manners, such as by layer thickness.

The examples shown here are not limiting; both of the two types of layer structures listed above can be combined in different regions of a single material by extending the disclosed technique to incorporate more processing segments, or by transitioning a deposit between baths of different chemistry, or temperature, or by dynamically changing the bath chemistry or temperature. The technology can also be used in conjunction with, e.g., pulse plating or reverse pulse plating. More than just regular, alternating layers can be produced. Three, or four, or more alternating layer types can be produced, and even non-alternating (graded, non-graded, random, etc.) patterns of layers of any number are possible.

Taken together, all of the above results evidence an extremely diverse array of new materials that can be formed comprising microcrystalline, nanocrystalline, and even amorphous Al—Mn. No other system or process known to the inventors hereof has produced such a diversity of multi-scale composite nanostructures. Each layer can be tuned to deliver an optimum for one or more desirable properties, and multiple layers can be used to provide balance among these optima.

For example, we may envision a sheet of material electroformed using this technology (i.e. produced on a substrate and then subsequently removed from the substrate), with various layers that simultaneously deliver high strength, tensile ductility and fracture toughness. We may envision a coating with various layers that combine to deliver optimal corrosion protection, in combination with hardness or other desirable properties. Net shape electroforms with such combinations of properties can also be envisioned.

Nanoindentation tests performed on sample cross-sections revealed a significant increase in hardness with Mn concentration (Table I). Table 1 is a summary of composition, microstructure and mechanical properties of three multilayered Al—Mn bodies, prepared at various $MnCl_2$ concentrations. Local Mn concentration are determined using EDS in scanning transmission electron microscopy mode at probe size of 1 nm. XRD grain sizes are estimated with ±15% accuracy TEM grain sizes are estimated using line-intercept method from bright-field, dark-field, or high-resolution TEM images. Each reported hardness value is averaged from ten measurements.

TABLE 1

| Sample | $MnCl_2$ (mol/L) | Mn concentration (at. %) Layer A | Mn concentration (at. %) Layer B | Lattice constant (Å) | Area % of FCC peaks | XRD grain size (nm) |
|---|---|---|---|---|---|---|
| 1 | 0.06 | 4.5 ± 0.3 | 6.2 ± 0.2 | 3.9972 | 100 | — |
| 2 | 0.09 | 9.6 ± 0.5 | 10.9 ± 0.5 | 3.9908 | 47 ± 1 | 32 ± 2 |
| 3 | 0.12 | 13.1 ± 1.0 | 15.9 ± 0.7 | 4.0308 | 17 ± 1 | 4 ± 1 |

| Sample | TEM grain size (nm) Layer A | TEM grain size (nm) Layer B | Layer wavelength (nm) | Layer thickness ratio $\lambda_A/\lambda_B$ | Hardness (Gpa) |
|---|---|---|---|---|---|
| 1 | 7,900 ± 3,000 | | 277 ± 7 | 0.87 | 2.49 ± 0.09 |
| 2 | 52 ± 24 | 21 ± 8 | 565 ± 24 | 0.93 | 3.80 ± 0.12 |
| 3 | 5.2 ± 2 | 3.2 ± 1 | 305 ± 7 | 0.92 | 4.22 ± 0.08 |

This is believed to arise from the increasing prevalence of nanostructure across these samples. The high hardness values of samples 2 and 3 correspond to specific strength of more than 400 kN·m/kg (assuming a factor of three proportionality between hardness and strength), well in excess of most commercial engineering alloys.

The additional possibility of balancing other important properties (toughness, work hardening, rate sensitivity, etc.) using the multilayering approach demonstrated here presents an interesting direction for future work in design and optimization of multi-scale nanocrystalline materials. For example, graded materials can be designed with increasing grain size from a first to a last deposit such that grain size increases from the surface to interior targeting for superior fatigue resistance, since the nano grains at the surface could minimize crack initiation while the coarse grains from the interior would prevent crack propagation.

Thus, inventions hereof include methods, and articles. The methods include making articles by electrodeposit, using a single bath, with a different amplitude of current, current waveforms or voltage for a given period of time. The different amplitudes of current and/or voltage (referred to below as the electrodeposition parameters and also corresponding to different electric power levels) give rise to a different chemical composition within a layer of deposit made at one amplitude, as compared to a different amplitude or (power level). It can be determined precisely what deposit composition will arise from any given deposition parameter or (power level). Thus, by altering the deposit parameters, (power level) the composition within the layers can be altered, as desired.

It is also true that the structure (i.e., amorphous vs. nanocrystalline vs. microcrystalline) and where appropriate, grain size, of a given deposit, is governed to a significant extent by the composition of that deposit. Thus, by altering the deposit parameters (power levels), the grain size and/or deposit internal structure (i.e., amorphous vs. nanocrystalline vs. microcrystalline) within the layers can be altered, as desired. Thus, a designer can achieve, for any given layer, a desired structure (within the limits of the apparatus in use). Therefore, for any set of a plurality of layers, the designer can achieve any desired pattern of these grain sizes and/or structures (i.e., amorphous vs. nanocrystalline vs. microcrystalline), from one layer to the next and to the next and to the next.

From experience, the designer can thus, achieve a combination of properties, such as toughness, strain rate sensitivity, work hardening ability, ductility, etc. by providing a combination of different layers of different thicknesses and different grain sizes and/or structures (i.e., amorphous vs. nanocrystalline vs. microcrystalline).

The designer can also achieve unique properties by exploiting, not only the grain sizes and/or structures (i.e., amorphous vs. nanocrystalline vs. microcrystalline) of any given layer, or adjacent layers, but also the thicknesses of a series of layers (their wavelength). It is also believed that the thicknesses of a series of layers, their wavelength, will give rise to properties, which can be controlled, and selected.

These inventions have been demonstrated in ionic liquid baths, with the Al—Mn system. It is also believed that the same principals will apply to other element systems that can be deposited in ionic liquid baths: namely, that changing the deposition parameters of current and voltage amplitude (the power level) will give rise to control over the composition, and thus, the grain size of the deposit, and therefore, further, will give control over the mechanical and other physical (magnetic, electrical, and optical) properties of the deposit, with regard to individual layers, and with regard to composite articles of multiple layers.

It is believed to be widely applicable to other electrodeposited multi-component Al-based alloys. Possible alloying elements include La, Pt, Zr, Co, Ni, Fe, Cu, Ag, Mg, Mo, Ti, W, Co, Li and Mn, among many others that would be identifiable by those skilled in the art.

The foregoing discussion also specifically described deposition from a specific electrolyte. The discussion applies equally to deposition from any other ionic (non-aqueous) electrolyte, including organic electrolytes, aromatic solvents, toluene, alcohol, liquid hydrogen chloride, or molten salt baths. Additionally, there are many ionic liquids that may be used as a suitable electrolyte, including those that are protic, aprotic, or zwitterionic. Examples include 1-ethyl-3-methylimidazolium chloride, 1-ethyl-3-methylimidazolium N,N-bis(trifluoromethane) sulphonamide, or liquids involving imidazolium, pyrrolidinium, quaternary ammonium salts, bis(trifluoromethanesulphonyl)imide, bis (fluorosulphonyl)imide, or hexafluorophosphate. The discussion above applies to such electrolytes, and to many other suitable electrolytes known and yet to be discovered.

The foregoing discussion applies to the use of aluminum chloride as a salt species from which Al ions are supplied to the bath, and manganese chloride as a salt species from which Mn ions are supplied to the plating bath. The discussion also applies to other ion sources, including but not limited to metal sulfates, metal sulfamates, metal-containing cyanide solutions, metal oxides, metal hydroxides and the like. In the case of Al, $AlF_x$ compounds may be used, with x an integer (usually 4 or 6).

Inventions hereof also include compositions of matter that are bodies composed of layers of different thicknesses, and different compositions and grain sizes and/or structures (i.e., amorphous vs. nanocrystalline vs. microcrystalline), made using the control of the deposit parameters, as described above. The compositions are novel and unique, in that it has not, heretofore, been possible to fabricate such compositions of such elements.

Inventions hereof also include articles of manufacture, which are bodies coated with coatings made by such deposits. For instance, the articles may be-used for armor, aerospace applications, lightweight alternatives to heavier metals like steel, electroformed components, electronics casings, electrical connectors and connector shells, protective coatings, corrosion inhibiting coatings, galvanic coatings or corrosion protection systems, stiffening coatings for more compliant substrates, etc.

Inventions hereof also include methods of making articles as described above, by controlling the deposit parameters, as described above. The methods include using ionic baths, and materials systems that can be deposited using them. The methods entail controlling the deposit parameters (electrical power levels) to achieve the composition, and thus the grain sizes and/or structures (i.e., amorphous vs. nanocrystalline vs. microcrystalline) desired to achieve the mechanical and physical properties that are needed, as would be known from acquired experience. Further, the methods include using the deposition parameters to achieve layer thicknesses, or degree of gradation of composition and grain sizes and structures, throughout the thickness of the entire part, to achieve the desired properties.

This disclosure describes and discloses more than one invention. The inventions are set forth in the claims of this and related documents, not only as filed, but also as developed during prosecution of any patent application based on this disclosure. The inventors intend to claim all of the various inventions to the limits permitted by the prior art, as it is subsequently determined to be. No feature described herein is essential to each invention disclosed herein. Thus, the inventors intend that no features described herein, but not claimed in any particular claim of any patent based on this disclosure, should be incorporated into any such claim.

Some assemblies of hardware, or groups of steps, are referred to herein as an invention. However, this is not an admission that any such assemblies or groups are necessarily patentably distinct inventions, particularly as contemplated by laws and regulations regarding the number of inventions that will be examined in one patent application, or unity of invention. It is intended to be a short way of saying an embodiment of an invention.

An abstract is submitted herewith. It is emphasized that this abstract is being provided to comply with the rule requiring an abstract that will allow examiners and other searchers to quickly ascertain the subject matter of the technical disclosure. It is submitted with the understanding that it will not be used to interpret or limit the scope or meaning of the claims, as promised by the Patent Office's rule.

The foregoing discussion should be understood as illustrative and should not be considered to be limiting in any sense. While the inventions have been particularly shown and described with references to preferred embodiments thereof, it will be understood by those skilled in the art that various changes in form and details may be made therein without departing from the spirit and scope of the inventions as defined by the claims.

The corresponding structures, materials, acts and equivalents of all means or step plus function elements in the claims below are intended to include any structure, material, or acts for performing the functions in combination with other claimed elements as specifically claimed.

The invention claimed is:

1. A method for depositing an alloy comprising at least two metal constituents, the method comprising the steps of:

a. providing an ionic liquid comprising dissolved species of at least two metal constituents, which electrodeposit in different proportions from each other at different electrical power levels;

b. providing a first electrode and a second electrode in the liquid, coupled to a power supply configured to supply electrical power having periods of a first constant level and periods of a second, different constant level;

c. driving the power supply with the first electrical power level for a first duration to deposit a first type of an alloy of the at least two metal constituents on a substrate, the deposit of the first type having a first thickness based on the first duration; and d. driving the power supply with the second electrical power level for a second duration to deposit a second type of an alloy of the at least two metal constituents on the previously deposited alloy on the substrate, the deposit of the second type having a second thickness based on the second duration.

2. The method of claim 1, further comprising repeating each of steps c and d at least one additional time to deposit an alloy of a first type and to deposit an alloy of a second type.

3. The method of claim 1, further wherein a first property of the deposits of the first type and the second type arises due to the electrical power level by which the deposit was deposited.

4. The method of claim 1, further wherein a first property of the deposits of the first type and the second type arises due to the electrical power level by which the deposit was deposited, further comprising the step of driving the power supply to achieve a power level that corresponds to a desired instance of the first property.

5. The method of claim 3, the first property comprising grain size.

6. The method of claim 3, the first property comprising alloy composition.

7. The method of claim 5, further wherein a second property of the combined deposits of the first type and the second type, arises due to a thickness wavelength of the set of the first and second deposits and the grain size of the deposits of the first and the second types.

8. The method of claim 5, further wherein a second property of the combined deposits of the first type and the second type arises due to a thickness wavelength of the set of the first and second deposits and the grain size of the deposits of the first and the second types, further comprising the step of driving the power supply to achieve a power level that corresponds to a desired grain size and driving the power supply for a first duration and a second duration to achieve a wavelength that corresponds to a desired instance of the second property.

9. The method of claim 5, wherein the steps of driving the power supply with the first electric power level for a first duration and driving the power supply with the second electric power level for a second duration are conducted so that the average grain size of the first and second deposits is larger than a thickness wavelength of the set of the first and second deposits.

10. The method of claim 5, wherein the steps of driving the power supply with the first electric power level for a first duration and driving the power supply with the second electric power level for a second duration are conducted so that the average grain size of the first and second deposits is smaller than a thickness wavelength of the set of the first and second deposits.

11. The method of claim 5, wherein the steps of driving the power supply with the first electric power level for a first duration and driving the power supply with the second electric power level for a second duration are conducted so that the smallest grain size of the first and second deposits is larger than a thickness wavelength of the set of the first and second deposits.

12. The method of claim 5, wherein the steps of driving the power supply with the first electric power level for a first duration and driving the power supply with the second electric power level for a second duration are conducted so that the largest grain size of the first and second deposits is smaller than a thickness wavelength of the set of the first and second deposits.

13. The method of claim 5, wherein the steps of driving the power supply with the first electric power level for a first duration and driving the power supply with the second electric power level for a second duration are conducted so that in some portions of the deposit, the average grain size of the first and second deposits is larger than a thickness wavelength of the set of the first and second deposits and in an adjacent portion of the deposit, the average grain size of the first and second deposits is smaller than the thickness wavelength.

14. The method of claim 1, further comprising repeating each of steps 1a, b, c and d using a second ionic liquid that differs in composition from the first ionic liquid, to provide a deposit of a third and fourth types upon the deposit of the first and second types.

15. The method of claim 1, wherein the step of driving the power supply with the first electrical power level comprises driving the power supply to deliver a first constant current density and wherein the step of driving the power supply with the second electrical power level comprises driving the power supply to deliver a second constant current density.

16. The method of claim 1, wherein the step of driving the power supply with the first electrical power level comprises driving the power supply to deliver a first constant voltage and wherein the step of driving the power supply with the second electrical power level comprises driving the power supply to deliver a second constant voltage.

17. The method of claim 5, further comprising repeating each of steps c and d at least one additional time to deposit an alloy of a first type and to deposit an alloy of a second type, wherein the steps of repeating the step of driving the power supply with the first electrical power level and the step of driving the power supply with the second electrical power level comprises driving the power supply to deliver a series of different electrical power levels so that grain size varies from a first grain size at the first deposit through a plurality of grain sizes at subsequent deposits.

18. The method of claim 17, wherein the grain size varies such that the grain size increases from the first deposit to a last deposit.

19. A method for depositing an alloy comprising at least two metal constituents, the method comprising the steps of:

a. providing a first ionic liquid comprising dissolved species of at least two metal constituents, which electrodeposit in different proportions from each other at different electrical power levels;

b. providing a first electrode and a second electrode in the liquid, coupled to a power supply configured to supply electrical power having periods of a first constant level and periods of a second, different constant level;

c. driving the power supply with the first electrical power level for a first duration to deposit a first type of an alloy of the at least two metal constituents on a substrate, the deposit of the first type having a first thickness based on the first duration;

d. driving the power supply with the second electrical power level for a second duration to deposit a second type of an alloy of the at least two metal constituents on the previously deposited alloy on the substrate, the deposit of the second type having a second thickness based on the second duration resulting in a deposit of the first ionic liquid; and e. repeating each of steps a, b, c and d using a second ionic liquid that differs in composition from the first ionic liquid, to provide a deposit of a third and fourth types upon the deposit from the first ionic liquid.

20. The method of claim 1, one of the metal constituents being selected from the group consisting of Aluminum (Al), Titanium (Ti) and Magnesium (Mg).

21. The method of claim 20, an other of the metal constituents being selected from the group consisting of Lanthanum (La), Platinum (Pt), Zirconium (Zr), Cobalt (Co), Nickel (Ni), Iron (Fe), Copper (Cu), Silver (Ag), Magnesium (Mg), Molybdenum (Mo), Titanium (Ti), Tungsten (W), Lithium (Li) and Manganese (Mn).

22. The method of claim 20, the dissolved species being a compound of the form $AlF_x$, with x an integer chosen from the group consisting of 4 and 6.

23. The method of claim 1, one of the metal constituents being selected from the group consisting of Copper (Cu), Nickel (Ni), and Silver (Ag).

24. The method of claim 2, wherein the thickness of substantially all of the deposits of the first type are substantially equal.

25. The method of claim 2, wherein the thickness of at least some of the deposits of the first type are different from each other.

* * * * *